US009809237B2

(12) United States Patent
DeJarnatt et al.

(10) Patent No.: US 9,809,237 B2
(45) Date of Patent: Nov. 7, 2017

(54) GATE CROSSING ARM COLLISION DETECTION SYSTEM AND METHOD

(71) Applicant: Siemens Industry, Inc., Alpharetta, GA (US)

(72) Inventors: Barton DeJarnatt, Louisville, KY (US); Travis Pless, Waddy, KY (US)

(73) Assignee: SIEMENS INDUSTRY, INC., Alpharetta, GA (US)

( * ) Notice: Subject to any disclaimer, the term of this patent is extended or adjusted under 35 U.S.C. 154(b) by 0 days.

(21) Appl. No.: 15/010,362

(22) Filed: Jan. 29, 2016

(65) Prior Publication Data

US 2017/0217463 A1 Aug. 3, 2017

(51) Int. Cl.

| | |
|---|---|
| ***G05D 1/00*** | (2006.01) |
| ***G05D 3/00*** | (2006.01) |
| ***G06F 7/00*** | (2006.01) |
| ***G06F 17/00*** | (2006.01) |
| ***B61L 29/08*** | (2006.01) |
| ***B61L 23/00*** | (2006.01) |
| ***B61L 29/04*** | (2006.01) |

(52) U.S. Cl.
CPC ..... *B61L 29/08* (2013.01); *B61L 23/007* (2013.01); *B61L 29/04* (2013.01); *B61L 2201/00* (2013.01)

(58) Field of Classification Search
CPC ..... B61L 23/007; B61L 29/04
USPC ..... 701/19
See application file for complete search history.

(56) References Cited

U.S. PATENT DOCUMENTS 7,282,879 B2 10/2007 Miller
2005/0284987 A1* 12/2005 Kande ..... B61L 29/16 246/125

* cited by examiner

*Primary Examiner* — Maceeh Anwari

(57) ABSTRACT

A detection and warning system is provided for a railroad crossing. The system comprises a sensor configured to be mounted on an underside of a gate arm of a railroad crossing gate to detect a presence of a vehicle or other object that is obstructing the railroad crossing. The system further comprises a communication interface coupled to the sensor. In response to a detection of the vehicle or the other object, the communication interface to relay a warning signal indicative of a possible collision on the railroad crossing with the vehicle or the other object.

14 Claims, 5 Drawing Sheets

GATE CROSSING ARM COLLISION DETECTION SYSTEM AND METHOD

BACKGROUND

1. Field

Aspects of the present invention generally relate to operating railroad crossing gates and more specifically relate to detecting a vehicle or an object obstructing a railroad crossing gate to provide a timely warning to an oncoming train.

2. Description of the Related Art

At railroad crossings, gate arms are deployed to prevent motorists from entering the intersection and causing a collision with a train. Due to the time delay between the beginning of warning signals and the gate being lowered, many motorists attempt to cross the intersection before the route is blocked. Occasionally, due to traffic or mechanical/operational issues with automobiles, vehicles enter the rail intersection and stop moving, blocking the railroad crossing and creating a collision hazard. Many times, as in the case of the Metro North collision on Feb. 3, 2015, a vehicle will be struck by the gate crossing arm descending, resulting in the motorist ceasing operation and presenting a collision hazard.

Many attempts have been made to make railroad intersections safer for everybody involved. These include intersection monitoring, more elaborate warning methods, vehicle detection, etc. The basic methods employed are ones that have been in service for decades. These methods are warning signals including blinking lights, ringing bells, and road blocking crossing gates.

However, in the event a motorist vehicle, or any other obstruction, is within the travel path of the gate crossing arm, a collision between the gate crossing arm and the vehicle goes unnoted by an oncoming train as it does not get alerted about that obstruction near the gate crossing arm in advance when so the locomotive engineer could apply brakes to stop the train safely in time. This situation creates a serious safety issue for occupants of vehicles and passengers of trains.

Therefore, there is a need for gate crossing collision detection systems at railroad crossings that can detect a collision between a vehicle entering the crossing and a lowering crossing arm and signal an oncoming train of an obstruction on the tracks so that the locomotive stop before the crossing, avoiding a collision with the vehicle.

SUMMARY

Briefly described, aspects of the present invention relate to detecting a vehicle or an object contacting a railroad crossing gate to provide an advance warning to an engineer of a locomotive of a train to take a safety action. In particular, at railroad crossings, sensors are deployed on gate crossing arm to detect a collision between the gate crossing arm being lowered and a vehicle entering the crossing. Warning signals are transmitted to oncoming trains when a gate is being lowered and a contact event with a vehicle or an object is detected by a sensing circuit coupled to a sensing strip having a collision sensor placed underside of a gate crossing arm. When a vehicle enters a rail crossing, stops moving, and is struck by the lowering gate arm, blocking the railroad crossing and creating a collision hazard with the train, the collision with the gate arm is detected and a warning message is transmitted to the train to initiate a preventive action. In this way, a collision hazard presented by a vehicle struck by a descending gate crossing arm would be safely handled by embodiments of a detection and warning system of the present invention. One of ordinary skill in the art appreciates that such a detection and warning system can be configured to be installed in different environments where such detection and warning is needed, for example, in railroad crossings.

In accordance with one illustrative embodiment of the present invention, a detection and warning system is provided for a railroad crossing. The system comprises a sensor configured to be mounted on an underside of a gate arm of a railroad crossing gate to detect a presence of a vehicle or other object that is obstructing the railroad crossing. The system further comprises a communication interface coupled to the sensor. In response to a detection of the vehicle or the other object, the communication interface to relay a warning signal indicative of a possible collision on the railroad crossing with the vehicle or the other object.

In accordance with another illustrative embodiment of the present invention, a method is provided for detecting a vehicle or other object in a railroad crossing and providing a warning. The method includes detecting a presence of the vehicle or the other object in the railroad crossing with a sensor configured to be mounted on an underside of a gate arm of a railroad crossing gate. The method further includes, in response to detecting the presence of the vehicle or the other object, relaying a warning signal using a communication interface coupled to the sensor, the warning signal indicative of a possible collision on the railroad crossing with the vehicle or the other object.

In accordance with yet another illustrative embodiment of the present invention, a detection and warning system is provided for a railroad crossing. The system comprises an edge touch sensor having a sensing strip and a sensing circuit. The sensing strip is configured to be mounted on an underside of a gate arm of a railroad crossing gate. The sensing strip is coupled to the sensing circuit to detect an event of contact being made between a vehicle or other object and the sensing strip of the edge touch sensor. The system further comprises a wireless communication interface coupled to the edge touch sensor, wherein in response to a detection of the event of contact, the wireless communication interface to wirelessly relay to a wireless control interface of a locomotive engine approaching the railroad crossing a warning signal asking a locomotive engine operator to decrease speed of the locomotive engine in view of an advance notice of a possible collision to the locomotive engine operator via the warning signal.

DETAILED DESCRIPTION

To facilitate an understanding of embodiments, principles, and features of the present invention, they are explained hereinafter with reference to implementation in illustrative embodiments. In particular, they are described in the context of detecting a collision hazard in a railroad crossing to provide an advance warning for taking a preventive action by an engineer of an oncoming train to reduce speed of the train. Embodiments of the present invention, however, are not limited to use in the described devices or methods.

The components and materials described hereinafter as making up the various embodiments are intended to be illustrative and not restrictive. Many suitable components and materials that would perform the same or a similar function as the materials described herein are intended to be embraced within the scope of embodiments of the present invention.

A detection and warning system is provided which is capable of detecting a vehicle or an object obstructing a railroad crossing to provide a timely warning to an oncoming train. In particular, electrically operated edge sensing strips with collision sensors may be mounted on the underside of a gate crossing arm. These collision sensors employ pre-defined safety measures in the event of contact being made ("crushing event") with a vehicle or an object. In the event a motorist vehicle, or any other obstruction, is within the travel path of the gate crossing arm, a collision sensor coupled to a sensing circuit may be activated and signal an oncoming train that an obstruction near the gate crossing arm has been detected. An advance warning can be sent to a locomotive of the oncoming train wirelessly or by a track circuit encoding to signal the locomotive operator to decrease speed, resulting in a much shorter stopping distance. The sensing circuit may operate in a "fail safe" mode where the operational status of the collision sensor could impact the safety of a detection and warning system. In the event of a cut wire or a failed circuit, the system may broadcast a reduce speed command to all oncoming trains until the operational problem is remedied.

Accordingly, a safety system is provided for railroad crossings used by vehicles driven on roads crossing the tracks laid for trains plying on them. In one embodiment, in the event a motorist vehicle, or any other obstruction, is within the travel path of a gate crossing arm, a collision between the gate crossing arm and the vehicle is detected for an oncoming train and the train is alerted about that obstruction near the gate crossing arm in advance so a locomotive may apply brakes to stop the train safely in time. This solution ensures safety of occupants of vehicles and passengers of trains.

Figure 1:
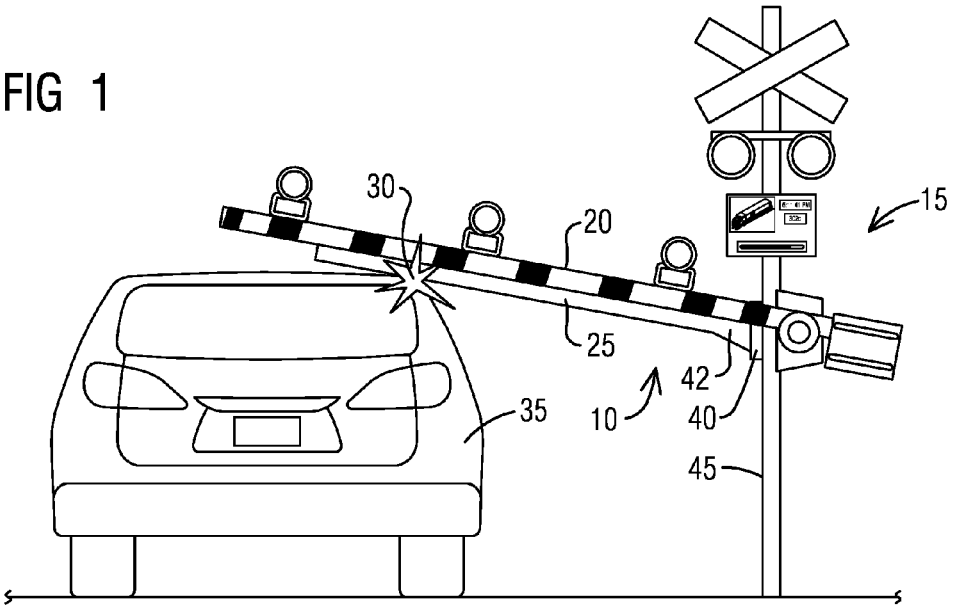
FIG. 1 illustrates a schematic diagram of a detection and warning system for use at a railroad crossing in accordance with one illustrative embodiment of the present invention.

FIG. 1 illustrates a schematic diagram of a detection and warning system 10 for use at a railroad crossing gate 15 in accordance with one illustrative embodiment of the present invention. The railroad crossing gate 15 includes a gate crossing arm 20. The detection and warning system 10 includes an electrically operated edge sensing strip 25 with collision sensors that is mounted on the underside of the gate crossing arm 20. The collision sensors of the electrically operated edge sensing strip 25 are configured to detect an event of contact 30 being made ("crushing event") with a vehicle 35.

The detection and warning system 10 further includes an electrical box 40 connected with a flexible electrical wire 42 to the electrically operated edge sensing strip 25. The electrical box 40 may be mounted on a crossing post 45. The electrical box 40 may include sensing means and means for generating and wirelessly transmitting a warning signal to controls (e.g., the conductor display) of a locomotive of an oncoming train for an engineer of the locomotive to view and react to the warning signal.

In the event the vehicle 35 is within the travel path of the gate crossing arm 20, a collision sensor coupled to a sensing circuit of the detection and warning system 10 may be activated and signal an oncoming train that an obstruction near the gate crossing arm 20 has been detected. An advance warning can be sent to the locomotive of the oncoming train wirelessly or by a track circuit encoding by the detection and warning system 10 to signal the engineer to decrease speed, resulting in a much shorter stopping distance. On the controls of the locomotive, the detection and warning system 10 may display a reduce speed command for the engineer to apply brakes of the train prior to reaching a rail track and a road intersection of the railroad crossing gate 15 where a collision hazard is present.

Figure 2A:
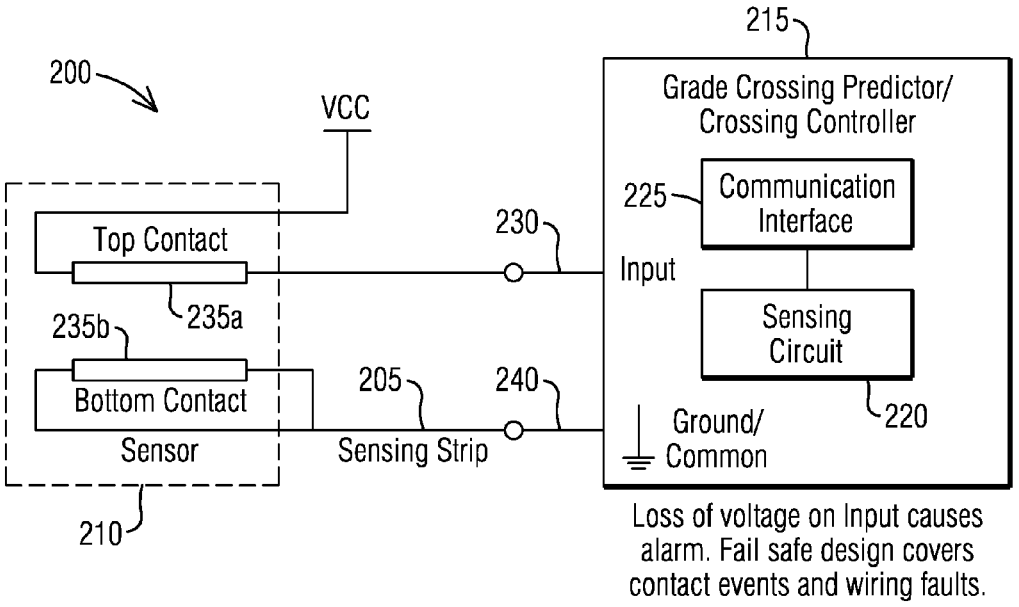
FIG. 2A illustrates a schematic diagram of a detection and warning system including a sensing strip with an edge crush collision sensor in accordance with one illustrative embodiment of the present invention.

FIG. 2A illustrates a schematic diagram of a detection and warning system 200 including a sensing strip 205 with an edge crush collision sensor 210 in accordance with one illustrative embodiment of the present invention. As used herein, "edge crush collision sensor" refers to a touch sensing device operable by sensing a drop in a voltage level at a controller. The "sensing strip" comprises an array of "edge crush collision sensors" connected together to form a sensing edge which when comes into contact with an obstruction, a closed circuit signal is created and is sent to the controller. The "detection and warning system," in addition to the exemplary hardware description in FIGS. 2-4, refers to a system that is configured to process radio and/or encoded signals, operated by a controller (including but not limited to a sensor control unit, a wireless control unit, a track control unit, and others). The detection and warning system 200 can include multiple interacting systems, whether located together or apart, that together perform processes as described herein.

The edge crush collision sensor 210 is mounted on an underside of a gate crossing arm of a railroad crossing gate to detect a presence of a vehicle or other object that is obstructing the railroad crossing. Examples of the edge crush collision sensor 210 include a touch sensor capable of detecting an object in response to an event of contact with the vehicle or the other object. For example, in one embodiment, the touch sensor may be an edge touch sensor.

The techniques described herein can be particularly useful for employing the edge crush collision sensor 210 on the bottom of the gate crossing arm 20. While particular embodiments are described in terms of an edge crush collision sensor, the techniques described herein are not limited to edge crush collision sensor but can be also used with other sensors, such as different types of proximity sensors which could be deployed on the bottom of the gate crossing arm 20.

In one embodiment, the sensing strip 205 may be configured to simply clip on a frame of the gate crossing arm 20. For example, on a 2" frame. A rigid base of the sensing strip 205 may extend beyond a sensitized portion of an edge sensor to form mounting flanges. To mount, ⅛" holes may be drilled through the mounting flanges and into the gate frame every 24 inches. To permanently attach the sensing strip 205 to the gate frame, #10 screws may be used.

The gate crossing arm 20 is preferably generally cylindrically shaped and has a predetermined outer diameter. It is understood by those skilled in the art that the gate crossing arm 20 could be configured in other geometrical shapes, such as square, rectangular, or triangular in cross-section without departing from the spirit and scope of the present invention.

In one embodiment, the gate crossing arm 20 is automatically driven by a standard drive mechanism (not shown) and travels generally in a vertical path between an open position and a closed position. Mechanisms (not shown) capable of actuating the gate crossing arm 20 are well-known to those skilled in the art and, therefore, further description thereof is omitted for purposes of convenience only and is not limiting.

Examples of the sensing strip 205 include various sensing strip structures described in U.S. Pat. No. 7,282,879 which is hereby incorporated herein by reference in its entirety and made part of the present U.S. Utility patent application for all purposes.

The sensing strip 205 is coupled to a grade crossing predictor/crossing controller 215. The grade crossing predictor/crossing controller 215 includes a sensing circuit 220 coupled to a communication interface 225.

The sensing circuit 220 of the grade crossing predictor/crossing controller 215 receives input from the sensing strip 205 at an input terminal 230. The grade crossing predictor/crossing controller 215 monitors a voltage level at the input terminal 230 to detect an event of contact or crushing event when a vehicle get stuck by a gate crossing arm. In response to an event of contact or a crushing event, there is a loss of voltage on the input terminal 230. This condition causes the grade crossing predictor/crossing controller 215 to generate an alarm as a warning signal to an oncoming train using the communication interface 225.

Consistent with one embodiment of the present invention, the sensing circuit 220 may be configured to operate in a fail-safe mode in that a reduce speed command is broadcast to all oncoming trains. A signal isn't broadcast all the time, but just when a collision is detected or the sensing circuit 220 is otherwise compromised or shorted. The transmit condition is a collision or circuit compromise. The do not transmit condition is no collision and proper functioning of the sensing circuit 220. A fail-safe mode is one that, in the event of a specific type of failure, the sensing circuit 220 responds in a way that will cause no harm, or at least a minimum of harm, to other devices or systems. A fail-safe mode also means that the sensing circuit 220 will not endanger lives on the train or the vehicle being near or on the tracks when it fails.

In one embodiment, the edge crush collision sensor 210 includes a top contact 235*a* and a bottom contact 235*b*. On one end the top contact 235*a* is connected to a voltage source VCC and on the other end it is connected to the input terminal 230. In one embodiment, the VCC voltage may be 5 volts. Other voltage levels are possible and can be suitably used based on a particular application without deviating from the spirit of the present invention. The bottom contact 235*b* is connected to a terminal 240 of the grade crossing predictor/crossing controller 215, which is grounded.

When the top contact 235*a* makes a contact with the bottom contact 235*b*, an event of contact or a crushing event is detected by the sensing circuit 220, as described above. In response to detection of the vehicle or the other object, the communication interface 225 may relay a warning signal indicative of a possible collision on the railroad crossing with the vehicle or the other object. For example, the communication interface 225 may wirelessly relay the warning signal to a wireless control interface of a locomotive engine. The warning signal may define an advance notice of a possible collision to a locomotive engine operator. In alternate embodiment, the communication interface 225 may include a track circuit to encode the warning signal for sending a warning via rail tracks to the locomotive engine.

Figure 2B:
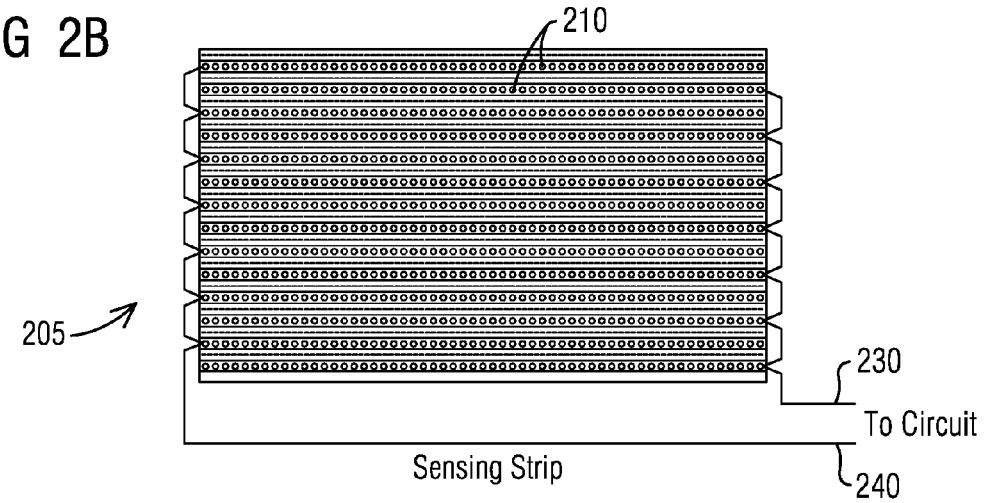
FIG. 2B illustrates a schematic diagram of a sensing strip with an array of edge crush collision sensors in accordance with one illustrative embodiment of the present invention.

FIG. 2B illustrates a schematic diagram of the sensing strip 205 with the array of edge crush collision sensors 210 in accordance with one illustrative embodiment of the present invention. Pairs of a positive sensor strip and a negative sensor strip are provided side-by-side from the array of edge crush collision sensors 210. The input terminal 230 connects all the positive sensor strips to the controller 215. The terminal 240 connects all the negative sensor strips to the ground GND. Persons skilled in the pertinent art would recognize that other alternating configurations of the array of edge crush collision sensors 210 may be deployed without undue experimentation and without departing from the scope and spirit of the present invention.

Figure 3:
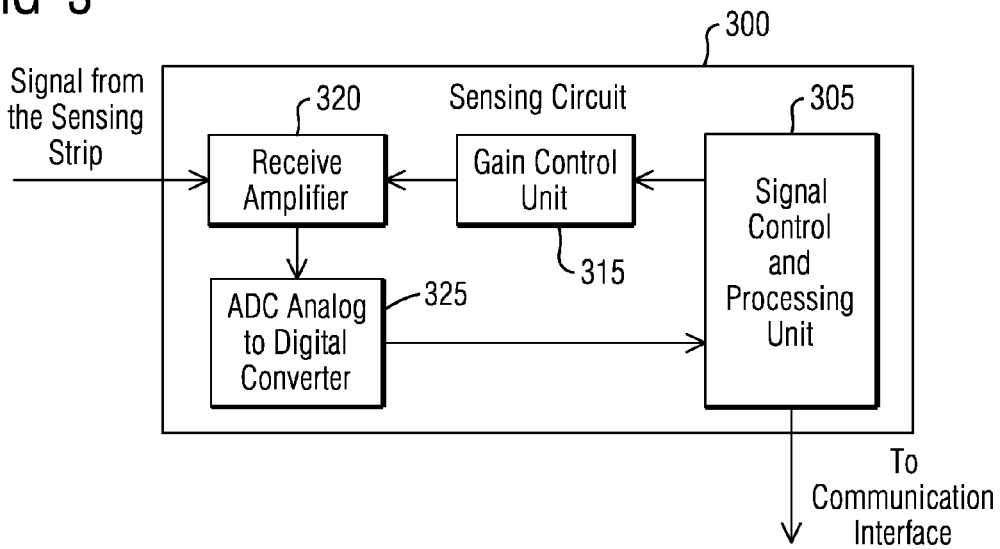
FIG. 3 illustrates a schematic diagram of the sensing circuit of FIG. 2A in accordance with one illustrative embodiment of the present invention.

FIG. 3 illustrates a detailed schematic diagram of the sensing circuit 220 of FIG. 2A in accordance with one illustrative embodiment of the present invention. A sensing circuit 300 comprises a signal control and processing unit 305. The sensing circuit 300 further comprises a gain control unit 315 coupled to a receive amplifier 320. The sensing circuit 300 further comprises an analog to digital converter (ADC) 325 to receive a signal from the receive amplifier 320 and provide an output to the signal control and processing unit 305. The receive amplifier 320 receives a signal from the sensing strip 205 of FIG. 2A. The signal control and processing unit 305 provides an output to the communication interface 225 of FIG. 2A.

Figure 4:
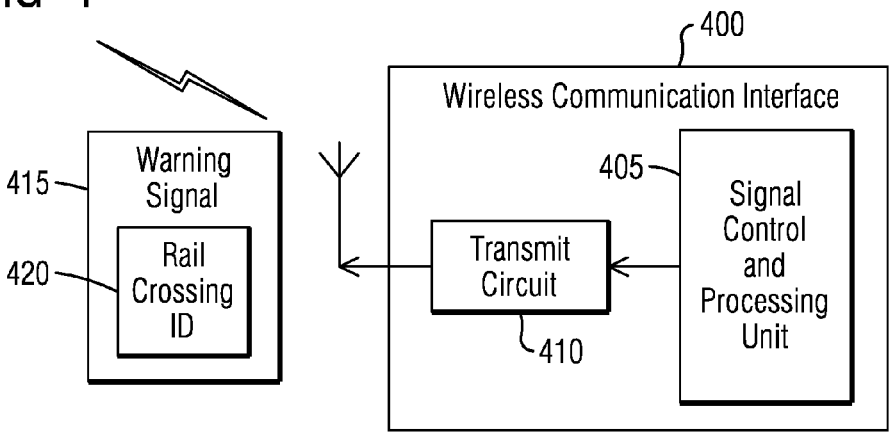
FIG. 4 illustrates a schematic diagram of the communication interface of FIG. 2A in accordance with one illustrative embodiment of the present invention.

FIG. 4 illustrates a detailed schematic diagram of the communication interface 225 of FIG. 2A in accordance with one illustrative embodiment of the present invention. A wireless communication interface 400 comprises a signal control and processing unit 405 coupled to a transmit circuit 410 with an antenna that transmits a warning signal 415 to controls of a locomotive of an oncoming train. The warning signal 415 includes a railroad crossing identification (ID) number 420, which identifies a railroad crossing to a wireless control interface of a locomotive engine.

Figure 5A:
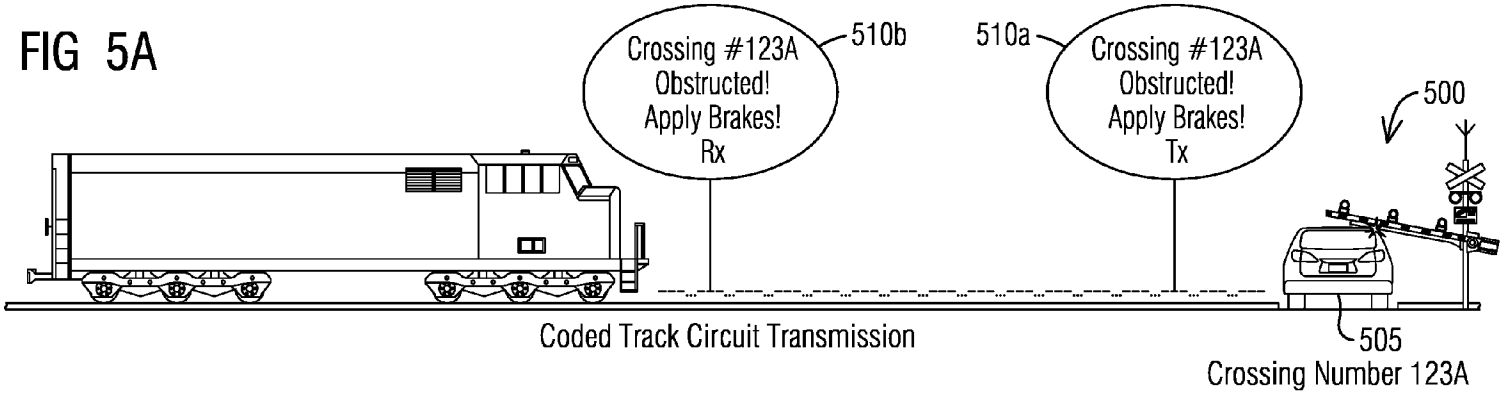
FIG. 5A illustrates a schematic diagram of a coded track circuit transmission in accordance with one illustrative embodiment of the present invention.

FIG. 5A illustrates a schematic diagram of a coded track circuit transmission in accordance with one illustrative embodiment of the present invention. At a railroad crossing 500 having a crossing number 123A in the event of a collision hazard created by a vehicle 505, a warning signal 510*a* "crossing #123A obstructed! Apply Brakes!" is transmitted by the communication interface 225 of FIG. 2A using a track circuit. A warning signal 510*b* "crossing #123A obstructed! Apply Brakes!" is received by the controls of the locomotive from the track circuit.

Figure 5B:
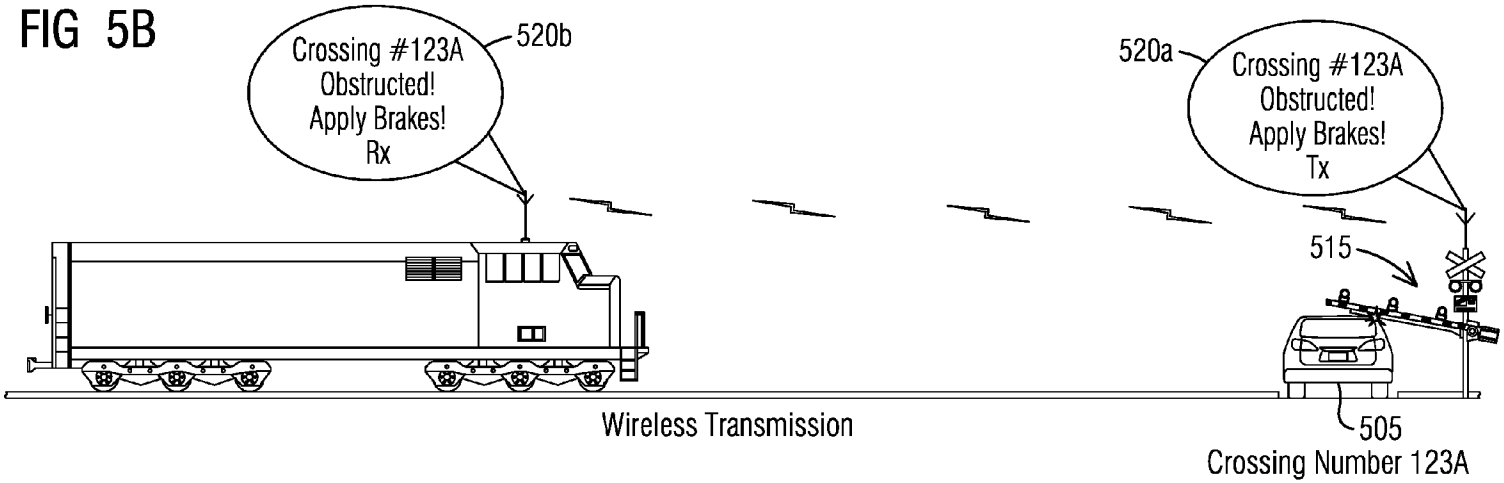
FIG. 5B illustrates a schematic diagram of a wireless transmission in accordance with one illustrative embodiment of the present invention.

FIG. 5B illustrates a schematic diagram of a wireless transmission in accordance with one illustrative embodiment of the present invention. At a railroad crossing 515 having a crossing number 123A in the event of a collision hazard created by the vehicle 505, a warning signal 520*a* "crossing #123A obstructed! Apply Brakes!" is transmitted by the communication interface 225 of FIG. 2A using the wireless communication interface 400 of FIG. 4. A warning signal 520*b* "crossing #123A obstructed! Apply Brakes!" is received by the controls of the locomotive from the wireless communication interface 400.

Figure 6A:
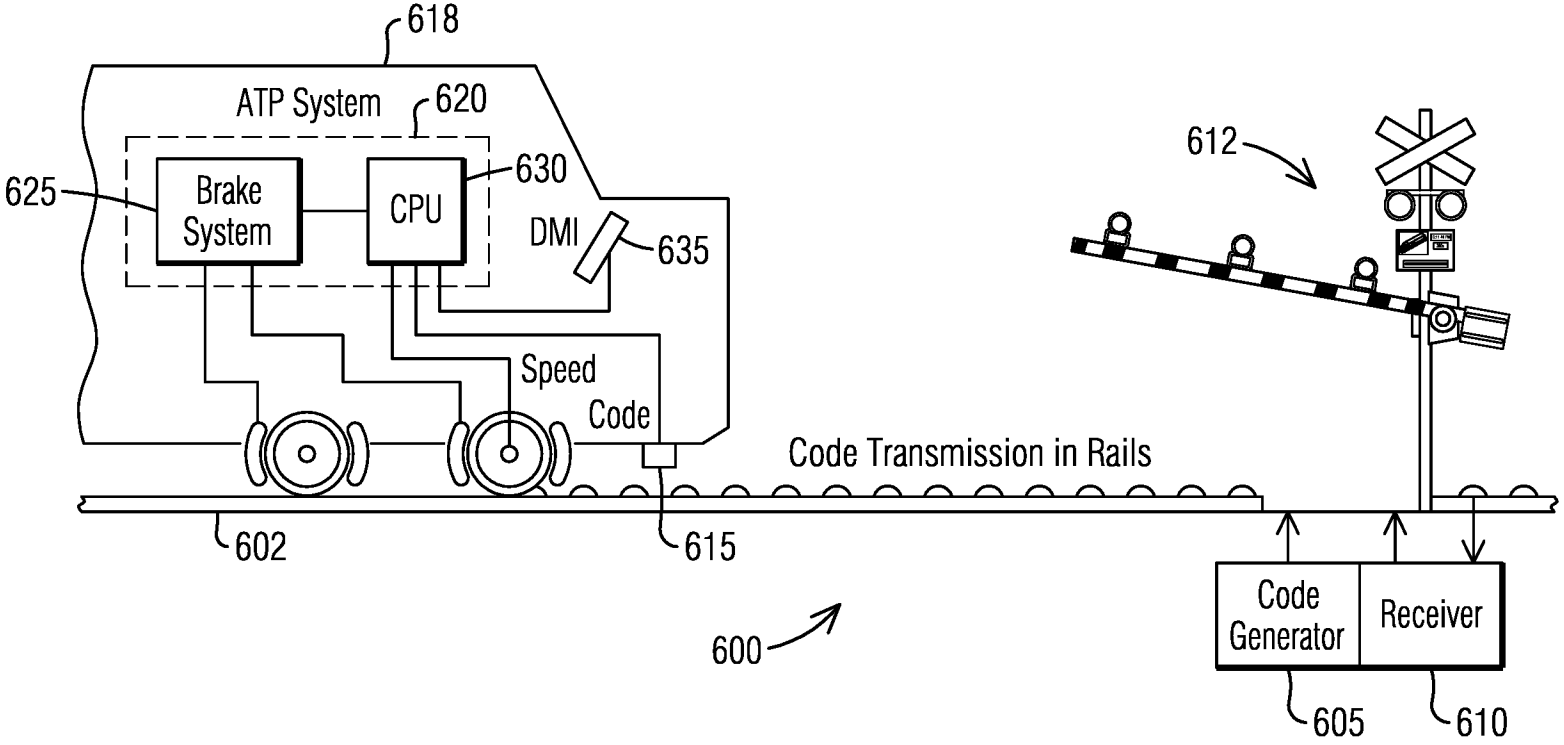
FIG. 6A illustrates a schematic diagram of a track circuit for the coded track circuit transmission of FIG. 5 in accordance with one illustrative embodiment of the present invention.

FIG. 6A illustrates a schematic diagram of a track circuit 600 for the coded track circuit transmission of FIG. 5 in accordance with one illustrative embodiment of the present invention. The track circuit 600 is configured for wired encoded transmission through rails of a railway track 602. The track circuit 600 comprises a code generator 605, a receiver 610 of a railroad crossing 612, pick up coils 615 of a locomotive 618 and an automatic train protection (ATP) system 620 of the locomotive 618. The ATP system 620 may include a brake system 625 and a central processing unit (CPU) 630. A display control 635 is coupled to the ATP system 620 for viewing by an engineer of the locomotive 618. The display control 635 acts as a user interface to an engineer or an operator of the locomotive 618 or a locomotive engine.

Figure 6B:
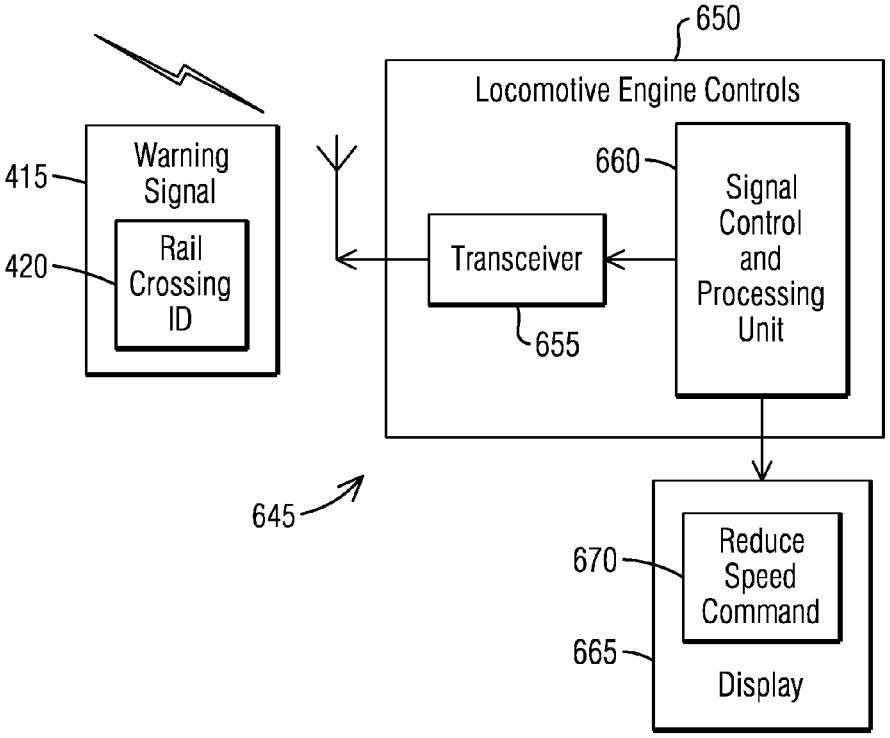
FIG. 6B illustrates a schematic diagram of a wireless circuit for the wireless transmission of FIG. 5B in accordance with one illustrative embodiment of the present invention.

FIG. 6B illustrates a schematic diagram of a wireless circuit 645 for the wireless transmission of FIG. 5B in accordance with one illustrative embodiment of the present invention. As shown, locomotive engine controls 650 include a transceiver 655, a signal control and processing unit 660 and a display 665. While the transceiver 655 may receive the warning signal 415 that includes the railroad crossing ID 420 from the wireless communication interface 400, the display 665 may display a reduce speed command 670 for the engineer of the locomotive 618.

In one embodiment, the locomotive engine controls 650 may include a computer that is capable of applying the brakes of the train automatically when the warning signal 415 is received without waiting or involving the engineer of the locomotive 618. In particular, the warning signal 415 is sent to the train's computer and the train automatically calculates a braking curve and slows the train down without input from the locomotive operator or engineer. In addition, the locomotive engineer or operator may be given a set amount of time to respond to the warning signal 415 from the railroad crossing. When the locomotive operator or engineer fails to respond in time, the computer of the train brakes the train on its own.

Figure 7:
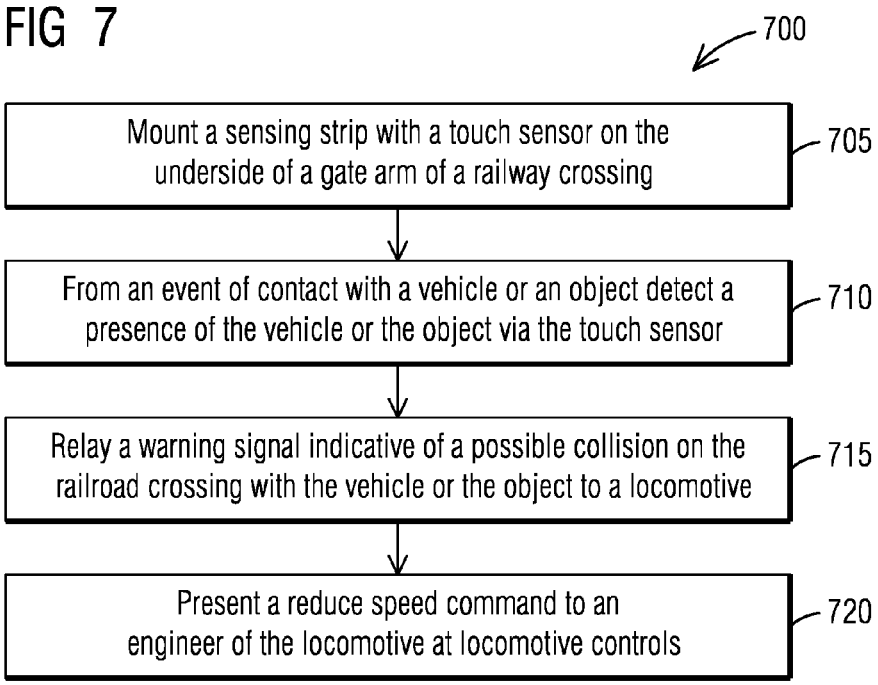
FIG. 7 illustrates a flow chart of a method for detecting a collision hazard in a railroad crossing to provide an advance warning for taking a preventive action in accordance with an exemplary embodiment of the present invention.

FIG. 7 illustrates a flow chart of a method 700 for detecting a collision hazard in a railroad crossing to provide an advance warning for taking a preventive action in accordance with an exemplary embodiment of the present invention. Reference is made to the elements and features described in FIGS. 1-5A, 5B, 6A and 6B. It should be appreciated that some steps are not required to be performed in any particular order, and that some steps are optional.

In step 705, the sensing strip 205 along with a touch sensor (e.g., the sensor 210) is mounted on the underside of the gate crossing arm 20 of the railroad crossing gate 15. In step 710, from the event of contact 30 with the vehicle 35, a presence of the vehicle 35 or an object is detected via the touch sensor.

In step 715, the warning signal 415 indicative of a possible collision on the railroad crossing gate 15 is relayed to the locomotive 618. For example, the warning signal 415 may be transmitter wirelessly or in a wired form of transmission as described above with respect to FIGS. 6A and 6B.

In step 720, the reduce speed command 670 is presented to an engineer of the locomotive 618 at the locomotive engine controls 650 via the display 665. In one embodiment, a train computer may apply the brakes of the train automatically when the warning signal 415 is received without waiting or involving the engineer of the locomotive 618.

Accordingly, a simple, retrofit solution is provided by various embodiments of the present invention that would increase the safety of railroad crossings that employ gate crossing arms. Consistent with one embodiment, the above set forth techniques give the locomotive operator an advance notice of a possible collision, which enable reducing speeds and reducing collisions. Various embodiments of the present invention provide a relatively simple and cheap solution that greatly improves safety at railroad crossings. The modular nature of the detection and warning system 200 also allows for implementation on existing grade crossings with minimal installation efforts required.

By maintaining a safe and clear intersection, as well as by providing an advanced warning of any impending collision hazards, safety is increased as collisions caused by stranded motorists in within the crossing intersection will be reduced. This concept can be integrated into future and currently deployed crossings, allowing for owners to retrofit crossings with the gate arm collision detections. Embodiments of the present invention accordingly increase the overall safety and reliability of railroading.

Another benefit is that they provide a simple solution that leads to reduced railway downtime and negative publicity from collision investigations for all railroad operations.

While embodiments of the present invention have been disclosed in exemplary forms, it will be apparent to those skilled in the art that many modifications, additions, and deletions can be made therein without departing from the spirit and scope of the invention and its equivalents, as set forth in the following claims.

Embodiments and the various features and advantageous details thereof are explained more fully with reference to the non-limiting embodiments that are illustrated in the accompanying drawings and detailed in the following description. Descriptions of well-known starting materials, processing techniques, components and equipment are omitted so as not to unnecessarily obscure embodiments in detail. It should be understood, however, that the detailed description and the specific examples, while indicating preferred embodiments, are given by way of illustration only and not by way of limitation. Various substitutions, modifications, additions and/or rearrangements within the spirit and/or scope of the underlying inventive concept will become apparent to those skilled in the art from this disclosure.

As used herein, the terms "comprises," "comprising," "includes," "including," "has," "having" or any other variation thereof, are intended to cover a non-exclusive inclusion. For example, a process, article, or apparatus that comprises a list of elements is not necessarily limited to only those elements but may include other elements not expressly listed or inherent to such process, article, or apparatus.

Additionally, any examples or illustrations given herein are not to be regarded in any way as restrictions on, limits to, or express definitions of, any term or terms with which they are utilized. Instead, these examples or illustrations are to be regarded as being described with respect to one particular embodiment and as illustrative only. Those of ordinary skill in the art will appreciate that any term or terms with which these examples or illustrations are utilized will encompass other embodiments which may or may not be given therewith or elsewhere in the specification and all such embodiments are intended to be included within the scope of that term or terms.

In the foregoing specification, the invention has been described with reference to specific embodiments. However, one of ordinary skill in the art appreciates that various modifications and changes can be made without departing from the scope of the invention. Accordingly, the specification and figures are to be regarded in an illustrative rather than a restrictive sense, and all such modifications are intended to be included within the scope of invention.

Although the invention has been described with respect to specific embodiments thereof, these embodiments are merely illustrative, and not restrictive of the invention. The description herein of illustrated embodiments of the invention is not intended to be exhaustive or to limit the invention to the precise forms disclosed herein (and in particular, the inclusion of any particular embodiment, feature or function is not intended to limit the scope of the invention to such embodiment, feature or function). Rather, the description is intended to describe illustrative embodiments, features and functions in order to provide a person of ordinary skill in the art context to understand the invention without limiting the invention to any particularly described embodiment, feature or function. While specific embodiments of, and examples for, the invention are described herein for illustrative purposes only, various equivalent modifications are possible within the spirit and scope of the invention, as those skilled in the relevant art will recognize and appreciate. As indicated, these modifications may be made to the invention in light of the foregoing description of illustrated embodiments of the invention and are to be included within the spirit and scope of the invention. Thus, while the invention has been described herein with reference to particular embodiments thereof, a latitude of modification, various changes and substitutions are intended in the foregoing disclosures, and it will be appreciated that in some instances some features of embodiments of the invention will be employed without a corresponding use of other features without departing from the scope and spirit of the invention as set forth. Therefore, many modifications may be made to adapt a particular situation or material to the essential scope and spirit of the invention.

Respective appearances of the phrases "in one embodiment," "in an embodiment," or "in a specific embodiment" or similar terminology in various places throughout this specification are not necessarily referring to the same embodiment. Furthermore, the particular features, structures, or characteristics of any particular embodiment may be combined in any suitable manner with one or more other embodiments. It is to be understood that other variations and modifications of the embodiments described and illustrated herein are possible in light of the teachings herein and are to be considered as part of the spirit and scope of the invention.

In the description herein, numerous specific details are provided, such as examples of components and/or methods, to provide a thorough understanding of embodiments of the invention. One skilled in the relevant art will recognize, however, that an embodiment may be able to be practiced without one or more of the specific details, or with other apparatus, systems, assemblies, methods, components, materials, parts, and/or the like. In other instances, well-known structures, components, systems, materials, or operations are not specifically shown or described in detail to avoid obscuring aspects of embodiments of the invention. While the invention may be illustrated by using a particular embodiment, this is not and does not limit the invention to any particular embodiment and a person of ordinary skill in the art will recognize that additional embodiments are readily understandable and are a part of this invention.

Although the steps, operations, or computations may be presented in a specific order, this order may be changed in different embodiments. In some embodiments, to the extent multiple steps are shown as sequential in this specification, some combination of such steps in alternative embodiments may be performed at the same time.

Embodiments described herein can be implemented in the form of control logic in software or hardware or a combination of both. The control logic may be stored in an information storage medium, such as a computer-readable medium, as a plurality of instructions adapted to direct an information processing device to perform a set of steps disclosed in the various embodiments. Based on the disclosure and teachings provided herein, a person of ordinary skill in the art will appreciate other ways and/or methods to implement the invention.

It will also be appreciated that one or more of the elements depicted in the drawings/figures can also be implemented in a more separated or integrated manner, or even removed or rendered as inoperable in certain cases, as is useful in accordance with a particular application.

Benefits, other advantages, and solutions to problems have been described above with regard to specific embodiments. However, the benefits, advantages, solutions to problems, and any component(s) that may cause any benefit, advantage, or solution to occur or become more pronounced are not to be construed as a critical, required, or essential feature or component.

What is claimed is:

1. A detection and warning system for a railroad crossing, the system comprising:

a sensor configured to be mounted on an underside of a gate arm of a railroad crossing gate to detect a presence of a vehicle or other object that is obstructing the railroad crossing, the sensor including a sensing strip;

a sensing circuit coupled to the sensing strip to detect an event of contact being made between the vehicle or the object and the sensing strip of the sensor; and a communication interface coupled to the sensor, wherein in response to a detection of the vehicle or the other object, the communication interface relays to a locomotive approaching the railroad crossing a warning signal indicative of a possible collision on the railroad crossing with the vehicle or the other object, wherein the communication interface to relay the warning signal to a control interface of a locomotive engine, and wherein the sensing circuit is configured to operate in a fail-safe mode in that a reduce speed command is broadcast to all oncoming trains in case of a transmit condition when a collision or a circuit compromise is detected and no command is broadcast in case of a do not transmit condition when no collision is detected or the sensing circuit is functioning properly.

2. The system of claim 1, wherein the sensor is a touch sensor capable of detecting an object in response to an event of contact with the vehicle or the other object.

3. The system of claim 2, wherein the touch sensor is an edge touch sensor.

4. The system of claim 1, wherein the sensing strip is configured to be mounted on the underside of the gate arm of the railroad crossing gate, wherein a plurality of pairs of a positive sensor strip and a negative sensor strip are provided side-by-side from an array of edge crush collision sensors, and wherein a first terminal connects all the positive sensor strips to a controller and a second terminal connects all the negative sensor strips to a ground GND.

5. The system of claim 1, wherein the warning signal defines an advance notice of a possible collision to a locomotive engine operator.

6. The system of claim 1, wherein the communication interface includes a track circuit to encode the warning signal for sending a warning to the locomotive engine.

7. A method of detecting a vehicle or other object in a railroad crossing and providing a warning, the method comprising:

detecting a presence of the vehicle or the other object in the railroad crossing with a sensor configured to be mounted on an underside of a gate arm of a railroad crossing gate; and relaying a warning signal using a communication interface coupled to the sensor in response to detecting the presence of the vehicle or the other object, the warning signal indicative of a possible collision on the railroad crossing with the vehicle or the other object; and wirelessly relaying the warning signal to a wireless control interface of a locomotive engine, wherein the warning signal defines an advance notice of the possible collision to a locomotive engine operator; and using a sensing circuit that is configured to operate in a fail-safe mode in that a reduce speed command is sent to all oncoming trains, wherein the sensing circuit is coupled to a sensing strip to detect an event of contact being made between the vehicle or the object and the sensing strip of the sensor.

8. The method of claim 7, wherein detecting a presence of the vehicle or the other object further comprising:

detecting with a touch sensor an object in response to an event of contact with the vehicle or the other object.

9. The method of claim 8, wherein the touch sensor is an edge touch sensor.

10. The method of claim 8, wherein the communication interface includes a track circuit to encode the warning signal for sending a warning to the locomotive engine.

11. The method of claim 7, wherein detecting a presence of the vehicle or the other object further comprising:

using the sensing strip configured to be mounted on the underside of the gate arm of the railroad crossing gate.

12. A detection and warning system for a railroad crossing, the system comprising:

an edge touch sensor coupled to a sensing strip and a sensing circuit;

wherein the sensing strip is configured to be mounted on an underside of a gate arm of a railroad crossing gate, and wherein the sensing strip is coupled to the sensing circuit to detect an event of contact being made between a vehicle or other object and the sensing strip of the edge touch sensor; and a wireless communication interface coupled to the edge touch sensor, wherein in response to a detection of the event of contact, the wireless communication interface wirelessly relays to a wireless control interface of a locomotive engine of a train approaching the railroad crossing a warning to a locomotive engineer to stop the train before the crossing, and wherein the sensing circuit is configured to operate in a fail-safe mode in that a reduce speed command is broadcast to all oncoming trains in case of a transmit condition when a collision or a circuit compromise is detected and no command is broadcast in case of a do not transmit condition when no collision is detected or the sensing circuit is functioning properly.

13. The system of claim 12, wherein the wireless communication interface is configured to wirelessly relay to the wireless control interface a warning signal for applying the brakes of the train automatically without waiting or involving the locomotive engineer.

14. The system of claim 13, wherein a computer of the train automatically calculates a braking curve and slows the train down without an input from the locomotive engineer.

* * * * *